United States Patent [19]

Gwathmey

[11] Patent Number: 4,986,418

[45] Date of Patent: Jan. 22, 1991

[54] BLANK PREFORM AND TRAY PALLET

[75] Inventor: Richard B. Gwathmey, York County, S.C.

[73] Assignee: Pallet Systems, Inc., Rock Hill, S.C.

[21] Appl. No.: 397,041

[22] Filed: Aug. 22, 1989

[51] Int. Cl.[5] ..... B65D 5/32

[52] U.S. Cl. ..... 206/386; 108/51.3; 229/23 A; 248/346

[58] Field of Search ..... 108/51.3; 206/320, 386, 206/595-600, 497; 229/190, 198, 23 A, DIG. 1; 248/346

[56] References Cited

U.S. PATENT DOCUMENTS

| | | | |
|---|---|---|---|
| Re. 29,192 | 4/1977 | Anderson et al. | 108/51 |
| 1,892,983 | 1/1933 | Holmer | 229/198 |
| 2,103,373 | 12/1937 | McClure | 229/198 |
| 2,271,265 | 1/1942 | Kirby | 229/DIG. 1 |
| 2,951,669 | 9/1960 | Davidson | 248/120 |
| 3,052,397 | 9/1962 | Budd | 206/599 |
| 3,088,423 | 5/1963 | Budd | 108/51.3 |
| 3,443,684 | 5/1969 | Taylor | 229/DIG. 1 |
| 3,776,145 | 12/1973 | Anderson et al. | 108/51 |
| 3,904,105 | 9/1975 | Booth | 229/15 |
| 4,042,127 | 8/1977 | Brossia | 214/10 |
| 4,153,161 | 5/1979 | Taylor et al. | 206/386 |
| 4,287,265 | 9/1981 | McKnight | 206/586 |
| 4,378,743 | 4/1983 | McFarland | 108/51 |
| 4,444,354 | 4/1984 | Staelgraeve | 229/190 |
| 4,705,162 | 11/1987 | Kupersmit | 206/45 |

FOREIGN PATENT DOCUMENTS

| | | | |
|---|---|---|---|
| 0969980 | 9/1964 | United Kingdom | 229/190 |

*Primary Examiner*—Jimmy G. Foster

*Attorney, Agent, or Firm*—Rhodes, Coats & Bennett

[57] ABSTRACT

This invention relates to a cut and scored blank for forming a tray pallet, a preform formed by erecting the cut and scored blank, and the tray pallet formed from the blank and preform. The blank is formed of a planar body of sheet material cut and scored to form a substantially square main portion bounded by two cut edges and two score lines, each score line being parallel to an adjoining side cut edge of the body and being spaced from the adjoining side cut edge a predetermined distance which is a minor fraction of the length of the adjoining side cut edge, and the two score lines crossing adjacent one corner of the body to define with adjacent side cut edges of the body a square corner area. The body is cut along one of the score lines in such a manner that the square corner area is bounded by one score line and three cut side edges for facilitating folding of the body along the score lines and erection of the folded body into a preform in the form of a substantially square flat tray bounded along two sides of a raised lip and having a reinforced corner formed by lapped portions of the raised lip.

7 Claims, 3 Drawing Sheets

BLANK PREFORM AND TRAY PALLET

FIELD AND BACKGROUND OF INVENTION

This invention relates to a cut and scored blank for forming a tray pallet, a preform formed by erecting the cut and scored blank, and the tray pallet formed from the blank and preform.

Material handling has developed into a field in which substantial attention is given to the efficient assembly and movement of quantities of goods to be stored through the use of equipment of various types. Lift trucks of various types are among the types of material handling equipment used, for example, in warehouses and the like for handling goods of a wide variety of types. Certain types of lift trucks, known as clamp trucks, are used for handling materials which are consolidated into packages such as bales. Clamp trucks generally engage a package to be handled by gripping the package between a pair of clamps with an action similar to that of a pair of hands held with open palms in parallel, spaced positions and moved one toward the other.

Certain types of materials which may be consolidated for handling are relatively lightweight, such as paperboard blanks or foamed plastic products. In consolidating such materials heretofore, packages have been placed on pallets for handling by materials handling equipment such as lift trucks.

Conventionally, consolidation of materials such as paperboard blanks or foamed plastic products for palletized handling has used pallets of the platform type capable of receiving the forks of a fork lift truck therebeneath or pallets of the type known as slip pallets which require a special lift truck. Platform pallets are relatively heavy and expensive, and are more readily justified in handling materials which are more difficult to consolidate than are paperboard blanks and plastic products. Slip pallets, while less expensive than platform pallets, are limited in usefulness to particular weight and size ranges of consolidated materials, and thus are not generally useful with materials of a wide range of package sizes and weights.

BRIEF DESCRIPTION OF INVENTION

With the foregoing discussion in mind, it is an object of this invention to provide a form of pallet which is readily adjustable to loads of a range of sizes and weights which being adapted for economical use with conventional materials handling equipment. In realizing this object of the invention, those who produce and must handle products of the type such as sheet material blanks and preforms will be given an economical and readily usable form of pallet.

A further object of this invention is to provide a tray pallet which may be readily and easily made from blanks and preforms of suitable sheet material such as paperboard, and which may be consolidated with loads to be handled in a particularly convenient way. In realizing this object of the present invention, a blank having a particular configuration is provided and then folded along score lines and erected into a preform which is assembled with other like preforms to form the tray pallet of this invention.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
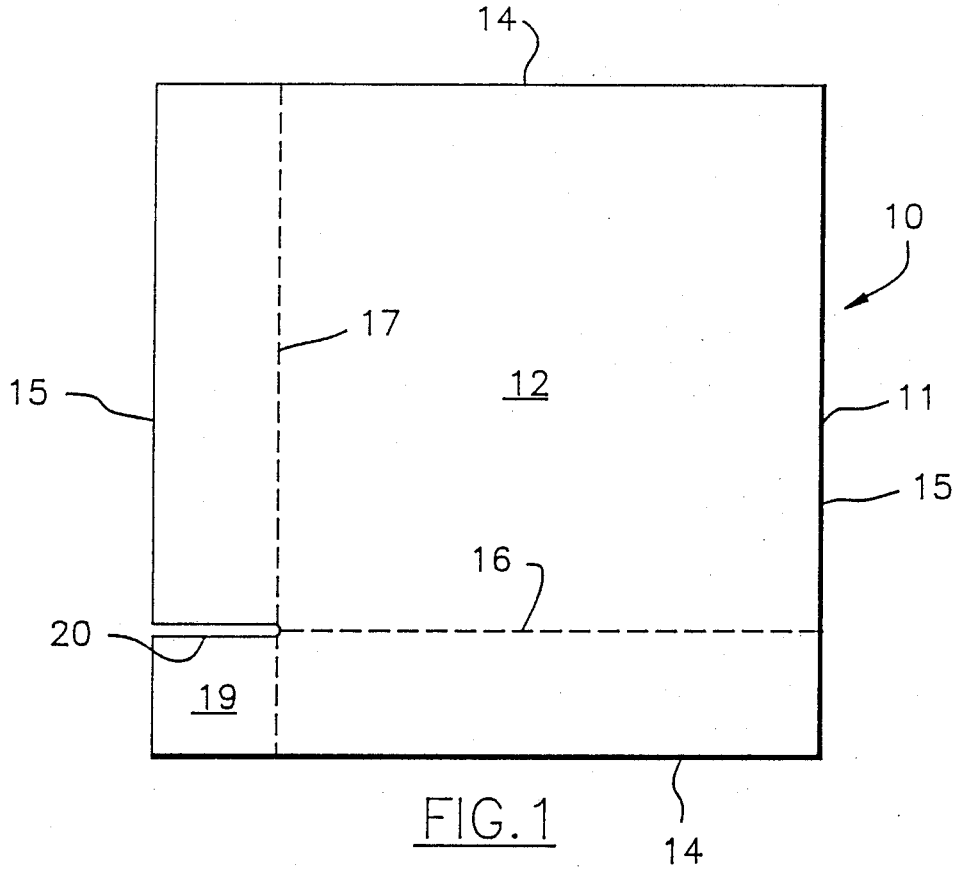
FIG. 1 is a plan view of a cut and scored blank of sheet material in accordance with this invention.

Referring now more particularly to the accompanying drawings, a blank in accordance with this invention is shown in FIG. 1 and generally identified at 10. The blank may be formed of any suitable sheet material which can be formed and described hereinafter. Preferably, the blank 10 is formed of corrugated paperboard having a pair of face plies spaced one from the other by a sandwiched corrugated ply, as is generally known to persons familiar with the paperboard arts. The term "paperboard" as used herein is intended to refer broadly to any sturdy sheet material made of paper, and includes such sheet materials in which one or more layers are formed by corrugated paper sheets.

The blank 10 is for forming a tray pallet as will be described more fully hereinafter and comprises a planar body 11 of sheet material cut and scored to form a substantially square main portion 12 bounded by two cut edges 14, 15 and two score lines 16, 17. Each score line 16, 17 is parallel to an adjoining one of the side cut edges 14, 15 of the body 10 and spaced from the adjoining side cut edge a predetermined distance which is a minor fraction of the length of the adjoining side cut edge. The two score lines 16, 17 cross adjacent one corner of the body 10 to define with the adjacent side cut edges 14, 15 a square corner area 19 of the body 10. The body 10 is also cut along one of the score lines 16 in such a manner that the square corner area 19 is bounded by one score line 17 and three cut side edges 14, 15, 20 for facilitating folding of said body along the score lines 16, 17 and erection of the folded body into a substantially square flat tray bounded along two sides by a raised lip and having a reinforced corner formed by lapped portions of the raised lip.

Figure 2:
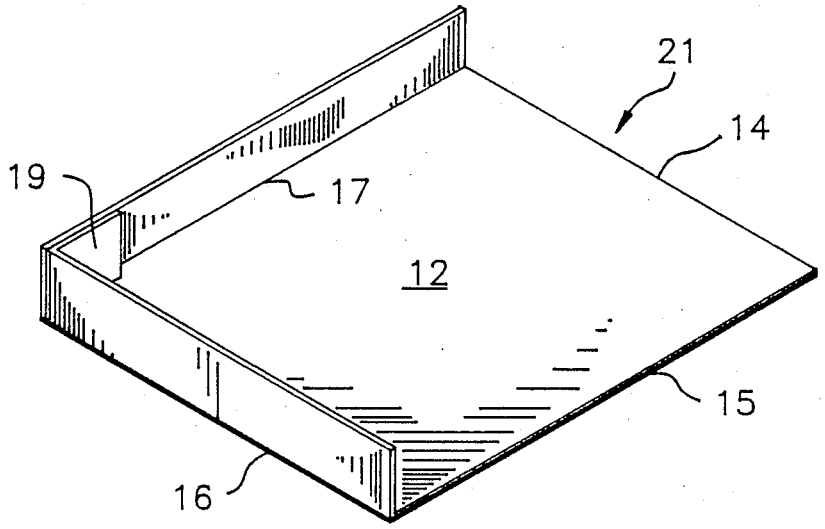
FIG. 2 is a perspective view of the blank of FIG. 1 as folded along the score lines and erected in a first preform.

As so folded and erected, the blank 10 form a first type of preform (FIG. 2 and as generally indicated at 21) for a pallet tray in accordance with this invention. The first type of preform 21 is a substantially square flat tray having a main portion 11 bounded along two contiguous sides by the cut edges 14, 15 described hereinabove. The tray has two raised lip portions joined to the main portion along the fold lines formed on folding the material of the blank along the fold lines 16, 17 described hereinabove. The lip portions bound two contiguous sides of the main portion and have a height which is a minor fraction of the length of a side cut edge of the main portion. The lip portions are joined at a contiguous corner by a lap portion formed by the minor area 20 which is joined to a contiguous one of said lip portions along a fold line and extends along the other of said lip portions The erected blank is held in erected form by means for securing together the lap portion and the other lip portion. The fastening means may take a number of forms, including adhesives, and a preferred form is staples.

Figure 3:
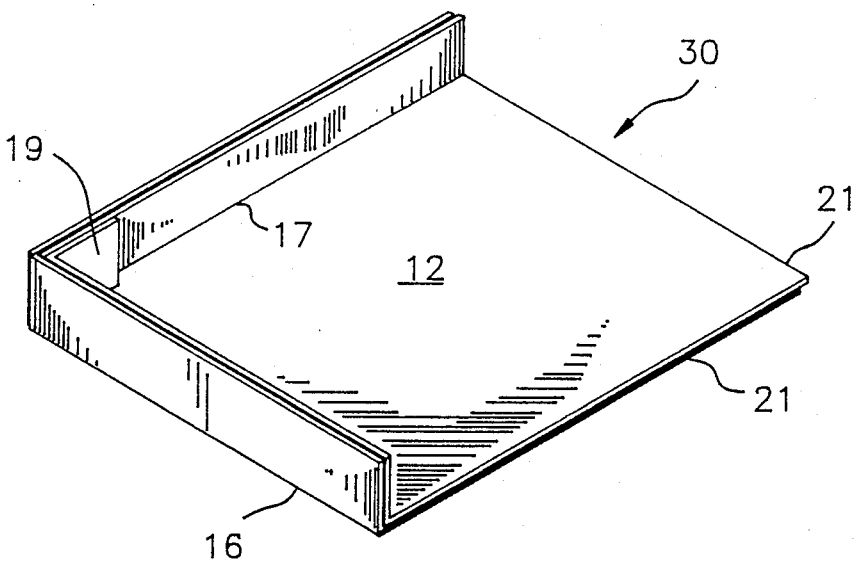
FIG. 3 is a view similar to FIG. 2 showing a second preform formed by securing together two of the preforms of FIG. 2.

Two of the first type preforms may be assembled into a second type of preform by stacking the two preforms and securing them together with the major areas thereof free one from the other. Such a second Preform is shown in FIG. 3 and generally indicated at 30. The second preform 30 has been formed of two first type preforms as described hereinabove. Thus the second preform has all of the elements of the first type preform, which will not be here described in detail.

What distinguishes the second type preform 30 from the first type 21 is the manner in which two of the first type preforms are stacked and secured together. More particularly, the two first type preforms are stacked with the lip portions contiguous each to another and the major areas 12 thereof overlying one another. The two first type preforms are secured together by suitable means engaging the lip portions, which may be adhesive or (as preferred) staples penetrating the lip portions. It is important (as will become more clear form the discussion which follows) that the major areas 12 of the preforms are not secured together.

Figure 4:
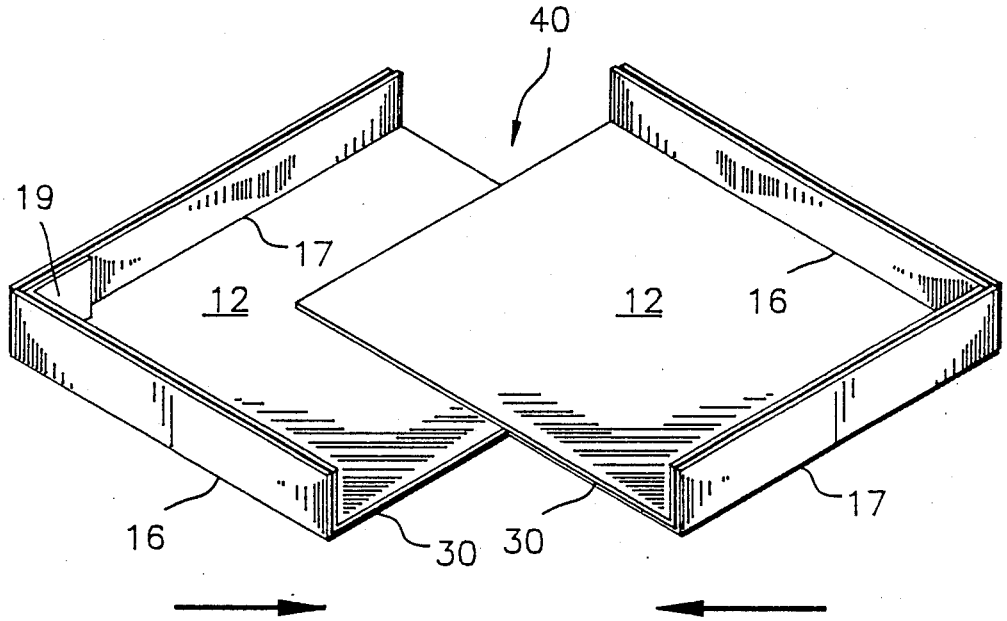
FIG. 4 is a view showing two of the preforms of FIG. 3 joined together to make a tray pallet in accordance with this invention.

In accordance with this invention, two of the second type preforms 30 may be joined together to form a tray pallet as shown in FIG. 4 and generally identified at 40. The tray pallet is formed by interleaving the major portions 11 of the two second type preforms 30, with the interleaving being such that the lowermost sheet of one preform is inserted between the sheets of the other. As so arranged, the two preforms 30 may be moved about to define a load bearing area which is generally rectangular and of dimensions suitable for the load to be borne. It is not necessary that the preforms be secured together, as will become more clear from the discussion which follows.

Figure 5:
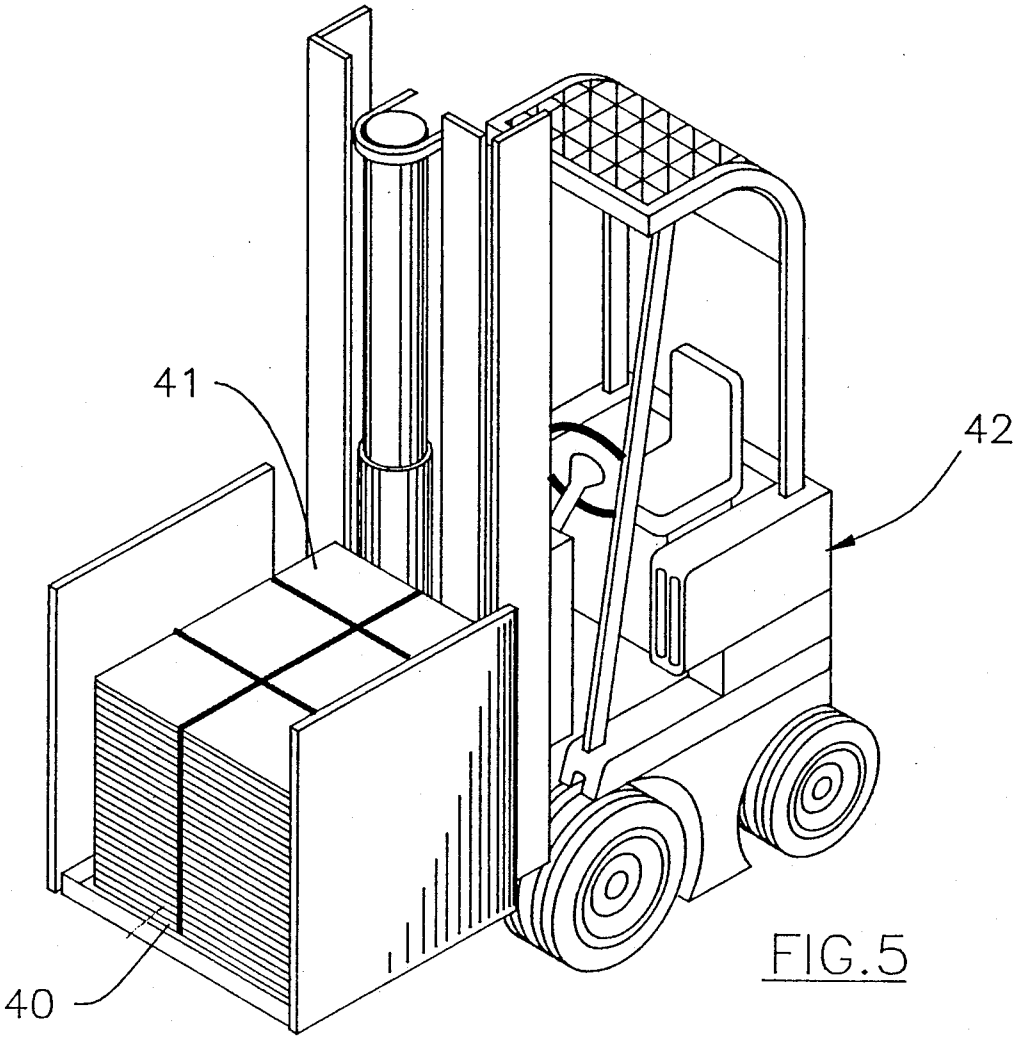
FIG. 5 is a view showing a package formed by a load and a pallet as shown in FIG. 4.

When a load such as a stack 41 (FIG. 5) of preforms for folded paperboard boxes is positioned on a tray pallet 40 in accordance with this invention, the pallet and load may be unitized by an encircling wrap of film or the like and then handled by materials handling equipment such as a clamp truck 42. In such use, the tray pallet 40 in accordance with this invention is adjusted to provide an area suitable for underlying the load applied. As such, the tray pallet 40 is also adapted for engaging and being lifted by more conventional fork type lift trucks.

As will be appreciated, the tray pallet of this invention is well adapted for producers of paperboard products such as preforms for folded boxes, in that the pallet itself is made by the same technology used in box manufacture, may be stored flat in blank from, and erected, sized and loaded as required.

In the drawings and specifications there has been set forth a preferred embodiment of the invention and, although specific terms are used, the description thus given uses terminology in a generic and descriptive sense only and not for purposes of limitation.

What is claimed is:

1. A preform for a pallet tray comprising;

a first body of sheet material cut, scored, folded and erected into a substantially square flat tray having a main portion bounded along two contiguous sides by cut edges and two raised lip portions joined to the main portion along fold lines bounding two contiguous sides of said main portion, said lip portions having a height which is a minor fraction of the length of a side cut edge of said main portion and being joined at a contiguous corner by a lap portion joined to a contiguous one of said lip portions along a fold line and extending along the other of said lip portions, and means for securing together said lap portion and said other lip portion;

a second body of sheet material cut, scored, folded and erected into a substantially square flat tray having a main portion bounded along two contiguous sides by cut edges and two raised lip portions joined to the main portion along fold lines bounding two contiguous sides of said main portion, said lip portions having a height which is a minor fraction of the length of a side cut edge of said main portion and being joined at a contiguous corner by a lap portion joined to a contiguous one of said lip portions along a fold line and extending along the other of said lip portions, and means for securing together said lap portion and said other lip portion; and means for securing together said first and second bodies of sheet material with said first and second body main portions overlying one another and said first and second body lip portions contiguous each to another, said means for securing together said first and second bodies joining said bodies at said lip portions so that said main portions are free of direct securement therebetween.

2. A pallet tray comprising:

first and second pallet preforms, each comprising a first body of sheet material cut, scored, folded and erected into a substantially square flat tray having a main portion bounded along two contiguous sides by cut edges and two raised lip portions joined to the main portion along fold lines bounding two contiguous sides of said main portion, said lip portions having a height which is a minor fraction of the length of a side cut edge of said main portion and being joined at a contiguous corner by a lap portion joined to a contiguous one of said lip portions along a fold line and extending along the other of said lip portions, and means for securing together said lap portion and said other lip portion;

a second body of sheet material cut, scored, folded and erected into a substantially square flat tray having a main portion bounded along two contiguous sides by cut edges and two raised lip portions joined to the main portion along fold lines bounding two contiguous sides of said main portion, said lip portions having a height which is a minor fraction of the length of a side cut edge of said main portion and being joined at a contiguous corner by a lap portion joined to a contiguous one of said lip portions along a fold line and extending along the other of said lip portions, and means for securing together said lap portion and said other lip portion; and means for securing together said first and second bodies of sheet material with said first and second body main portions overlying one another nd said first and second body lip portions contiguous each to another, said means for securing together said first and second bodies joining said bodies at said lip portions so that said main portions are free of direct securement therebetween, said first and second pallet preforms being positioned with said main portions of said bodies thereof in interleaved, stacked array and with said lip portions of said bodies thereof defining portions of the boundaries of a generally rectangular load receiving area, said first and second pallet preforms being movable one relative to the other for adjusting the size of the load receiving area defined thereby.

3. A bulk package adapted for handling by mechanized materials handling equipment and comprising a pallet tray comprising first and second pallet preforms, each comprising a first body of sheet material cut, scored, folded and erected into a substantially square flat tray having a main portion bounded along two contiguous sides by cut edges and two raised lip portions joined to the main portion along fold lines bounding two contiguous sides of said main portion, said lip portions having a height which is a minor fraction of the length of a side cut edge of said main portion and being joined at a contiguous corner by a lap portion joined to a contiguous one of said lip portions along a fold line and extending along the other of said lip portions, and means for securing together said lap portion and said other lip portion;

a second body of sheet material cut, scored, folded and erected into a substantially square flat tray having a main portion bounded along two contiguous sides by cut edges and two raised lip portions joined to the main portion along fold lines bounding two contiguous sides of said main portion, said lip portions having a height which is a minor fraction of the length of a side cut edge of said main portion and being joined at a contiguous corner by a lap portion joined to a contiguous one of said lip portions along a fold line and extending along the other of said lip portions, and means for securing together said lap portion and said other lip portion; and means for securing together said first and second bodies of sheet material with said first and second body main portions overlying one another and said first and second body lip portions contiguous each to another, said means for securing together said first and second bodies joining said bodies at said lip portions so that said main portions are free of direct securement therebetween, said first and second pallet preforms being positioned with said main portions of said bodies thereof in interleaved, stacked array and with said lip portions of said bodies thereof defining portions of the boundaries of a generally rectangular load receiving area, said first and second pallet preforms being movable one relative to the other for adjusting the size of the load receiving area defined thereby, a quantity of sheet material load elements stacked on said pallet tray load receiving area, and wrap means encircling said load elements and said pallet tray for unifying said pallet tray and said load elements for handling.

4. Apparatus according to claim 3 wherein said wrap means comprises film means encompassing said load elements and said pallet tray.

5. Apparatus according to one of claim 1 or claim 2 or claim 3 wherein said sheet material is corrugated paperboard.

6. Apparatus according to one of claim 1 or claim 2 or claim 3 wherein said means for securing said lap and said lip portions together comprises staple means penetrating said lap and said lip portions for joining the same together.

7. Apparatus according to one of claim 1 or claim 2 or claim 3 wherein said means for securing together said bodies of sheet material comprises staple means penetrating said lip portions for joining the same together.

* * * * *